US006398581B1

(12) United States Patent
Baier et al.

(10) Patent No.: US 6,398,581 B1
(45) Date of Patent: Jun. 4, 2002

(54) BUS CONNECTOR AND METHOD FOR INTEGRATING ELECTRICAL TEST POINTS IN THE BUS CONNECTOR

(75) Inventors: Terence D. Baier; Paul C. Rentmeester, both of La Crosse, WI (US)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/741,444

(22) Filed: Dec. 19, 2000

(51) Int. Cl.[7] ..... H01R 4/24
(52) U.S. Cl. ..... 439/404; 439/406; 439/912
(58) Field of Search ..... 439/404, 405, 439/406, 407, 511, 912

(56) References Cited

U.S. PATENT DOCUMENTS

| | | | | |
|---|---|---|---|---|
| 3,736,505 A | | 5/1973 | Sankey | 324/133 |
| 5,174,782 A | * | 12/1992 | Bogiel et al. | 439/404 |
| 5,199,899 A | * | 4/1993 | Ittah | 439/403 |
| 5,371,323 A | | 12/1994 | Schneider et al. | 174/92 |
| 5,498,172 A | * | 3/1996 | Noda | 439/404 |
| 5,606,150 A | * | 2/1997 | Radliff et al. | 174/92 |
| 5,722,851 A | * | 3/1998 | Onizuka et al. | 439/404 |
| 5,759,065 A | * | 6/1998 | Hatagishi et al. | 439/596 |

FOREIGN PATENT DOCUMENTS

| | | |
|---|---|---|
| WO | WO 97/05682 | 2/1997 |

* cited by examiner

*Primary Examiner*—Tulsidas Patel
(74) *Attorney, Agent, or Firm*—William J. Beres; William O'Driscoll

(57) ABSTRACT

A system for electrically connecting electrical components. The system comprises a ribbon cable, a connector cap and a connector base. The connector cap includes a track area adapted to operably engage the ribbon cable, a cap alignment guide, and a cap orientation guide. The connector base has a first ribbon cable receptacle area adapted to electrically engage the first ribbon cable, a second receptacle area adapted to electrically engage a second ribbon cable, electrical interconnection means electrically interconnecting the first and second receptacles, first and second base alignment guides respectively positioned adjacent the first and second receptacle areas for alignment with the cap alignment guide, and a orientation receptacle operably positioned to receive the cap orientation guide.

26 Claims, 4 Drawing Sheets

FIG. 1
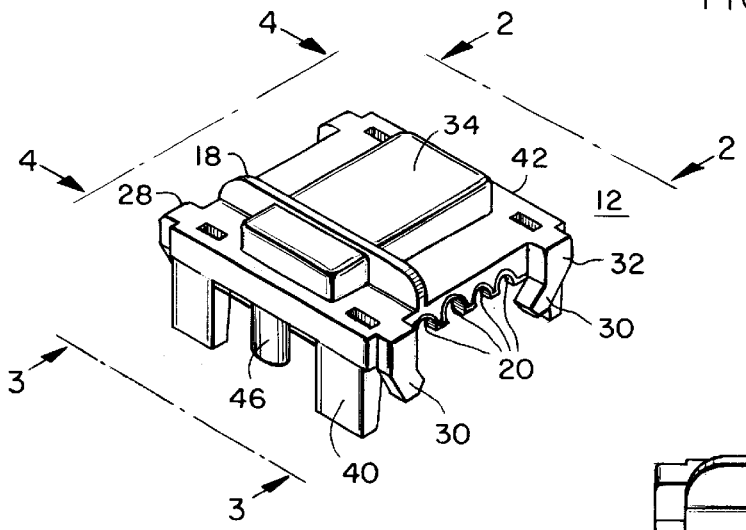
FIG. 2
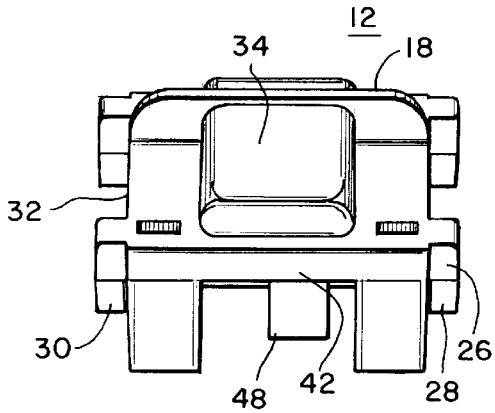
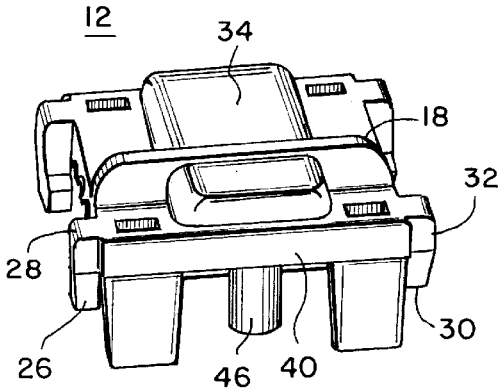
FIG. 3
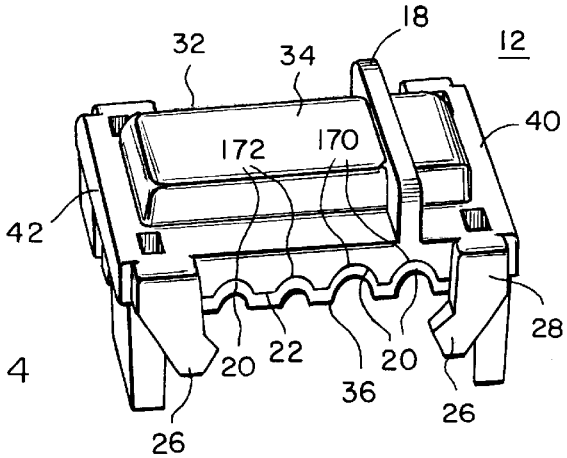
FIG. 4

BUS CONNECTOR AND METHOD FOR INTEGRATING ELECTRICAL TEST POINTS IN THE BUS CONNECTOR

BACKGROUND OF THE INVENTION

The present invention is directed to a bus connector which includes a pair of bus connector caps secured to a bus connector base so that each cap secures a bus cable in operable connection with the connector base. For purposes of this application, the words "bus", "cable" and "bus cable" are intended to encompass both a physical communications medium and the transmissions over that medium, unless it is otherwise apparent from the context.

In connecting electrical components to a communications bus or other similar bus cable, it is desirable that the connector of the bus be fixed relative to each other prior to the actual connector being completed. If the bus and the connector were slideably arranged, then the positioning of the electrical component and the connector relative to the bus could change prior to the connection being fixed.

It is also desirable that the connectors can be only assembled in one orientation so that the corresponding lines of a pair of buses being connected by the connector will be connected, as opposed to the connection of opposed lines if one of the buses were somehow reversed.

It is a problem of previous connectors that they cannot be tested on an individual connector basis since they are enclosed in a sealed insulated housing.

SUMMARY OF THE INVENTION

It is an object, feature and advantage of the present invention to solve the problem with prior electrical connectors.

It is an object, feature and advantage of the present invention to provide a bus connector including electrical test points for each of the electrical connections.

It is an object, feature and advantage of the present invention to provide a bus connector having a cap which can be placed in non-slideable relation with a communications bus.

It is a further object, feature and advantage of the present invention that the communications bus be a flat ribbon cable.

It is an object, feature and advantage of the present invention to provide an alignment guide to assist an assembler in correctly interconnecting a pair of buses with a bus connector device.

It is an object, feature and advantage of the present invention to provide projections, apertures and the like which can only be assembled in one orientation.

The present invention provides a system for electrically connecting electrical components. The system comprises a ribbon cable, a connector cap and a connector base. The ribbon cable has a first sized conductor, a second sized conductor, and a web around the first and second conductors. The connector cap includes a track area adapted to operably engage the ribbon cable, a cap alignment guide, and a cap orientation guide. The connector base has a first ribbon cable receptacle area adapted to electrically engage a ribbon cable, a second receptacle area adapted to electrically engage a second ribbon cable, electrical interconnection means electrically interconnecting the first and second receptacles, first and second base alignment guides respectively positioned adjacent the first and second receptacle areas for alignment with the cap alignment guide, and a orientation receptacle operably positioned to receive the cap orientation guide.

The present invention also provides a connector for operably connecting a first and a second communications bus. The connector comprises a connector base and a connector cap. The connector base includes first and second substantially identical cap engagement areas. Each cap engagement area includes tracks adapted to receive the first or second communications bus and contacts for each track adapted to electrically engage a portion of the communications bus. Each contact in a cap engagement area is in electrical connection with a corresponding contact in the other cap engagement area to form electrically connected pairs of contact. The first bus connector cap includes tracks sized to receive and retain the first or second communications bus. The connector base includes an external aperture in association with each pair of electrically connected contacts providing an external electrical access point thereto.

The present invention further provides an electrical connector for connecting first and second communications buses where each bus includes at least first and second conduits. The connector comprises a non-conductive housing and first and second cover portions. The non-conductive housing includes a first receptacle portion and first contacts for receiving a first bus and a second receptacle portion and second contacts for receiving a second bus. The housing further includes electrical connections operably and electrically interconnecting the first contacts with the second contacts. The first cover portion is adapted for and operably engages the first receptacle portion to form a first electrical connection between the first contacts and the first bus such that the first electrical connection is insulated from external electrical contacts. The second cover portion is adapted for and operably engages the second receptacle portion to form a second electrical connection between the second contacts and the second bus such that the second electrical connection is insulated from external electrical contacts. The housing further includes at least one electrical test point in operable connection with the first electrical connection wherein the electrical test point has an external contact surface allowing an external device to monitor at least one electrical condition of the respective connection.

BRIEF DESCRIPTION OF THE DRAWING

FIG. 1 is a perspective view of a bus connector cap in accordance with the present invention.

FIG. 2 is a off side view of the connector cap of FIG. 1.

FIG. 3 is a guide side view of the connector cap of FIG. 1 taken along lines 3—3.

FIG. 4 is a view of the connector cap of FIG. 1 taken along lines 4—4.

DETAILED DESCRIPTION OF THE INVENTION

Figure 5:
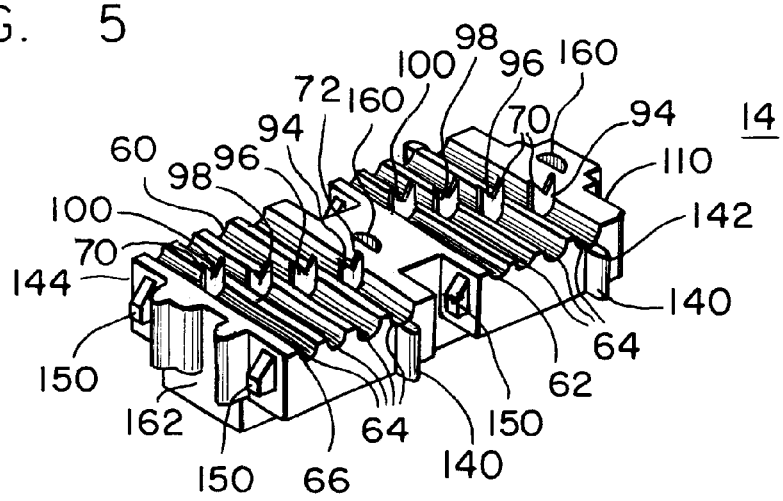
FIG. 5 is a perspective view of the connector base of the present invention taken from a first upper orientation.

Referring to all the figures of the drawing, the present invention is directed to a bus connector 10 which includes a pair of bus connector caps 12 secured to bus connector base 14 such that each cap 12 secures a bus 16 in operable connection with the base 14.

Now referring specifically to FIGS. 1–4, each cap includes a bus alignment guide 18 which is preferably color coded to enable an assembler to correctly align the bus 16 with the bus connector cap 12. The bus connector cap 12 preferably includes molded tracks 20 wherein the length of the bus connector cap 12 parallel to the direction of the guide 18 and sized to receive and retain an appropriate bus 16. Preferably, the tracks include a sealant 22 overlaying the tracks 20 on the cap 12 in a shape preformed to the bus 16 so as to provide a relatively impermeable seal about the bus 16 when the bus connector 10 is fully assembled.

The bus connector cap 12 also includes a pair of retaining arms 26 from a first end 28, and a second pair of retaining arms 30 on a second end 32. The guide 18 is on a top side 34 of the bus connector cap 12, while the tracks 20 are on a bottom side 36 of the bus connector cap 12. The bus connector cap 12 includes a guide side 40 nearest the guide 18 and an offside 42 farthest from the guide 18 where both the guide side 40 and the offside 42 are parallel to the guide 18. The guide side 40 includes an alignment projection 46 while the offside 42 includes an alignment projection 48. The alignment projection 46 and the alignment projection 48 have unique shapes to ensure that the bus connector cap 12 can only be attached to a bus connector base 14 in one unique arrangement. In the preferred embodiment, the alignment projection 46 has the shape of a half circle while the alignment projection 48 has a rectangular shape.

Figure 6:
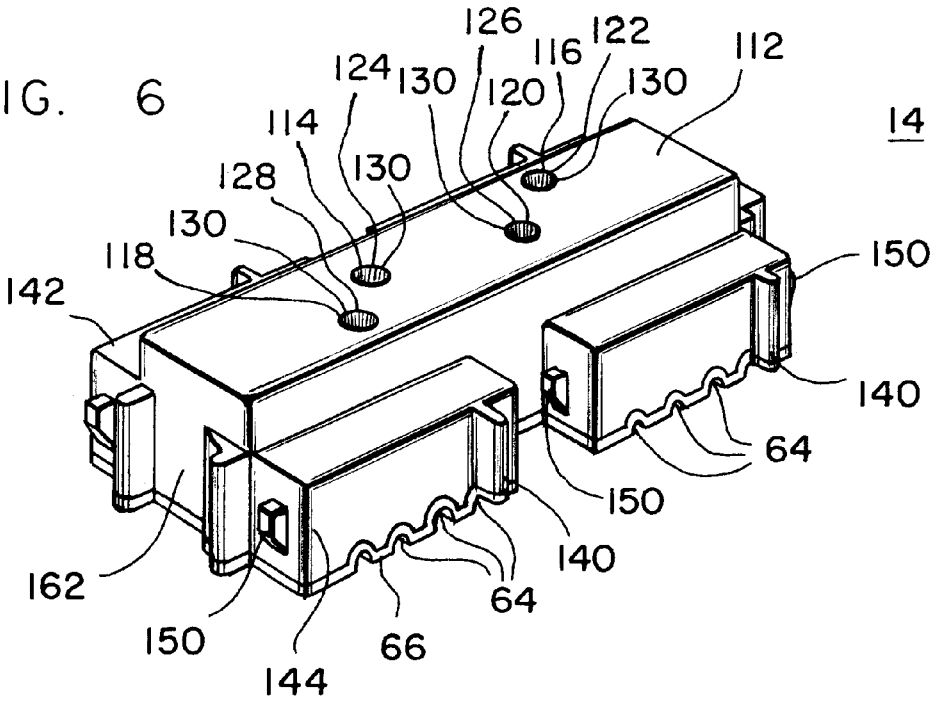
FIG. 6 is a perspective view of the connector base of FIG. 5 taken from a second lower orientation.
Figure 7:
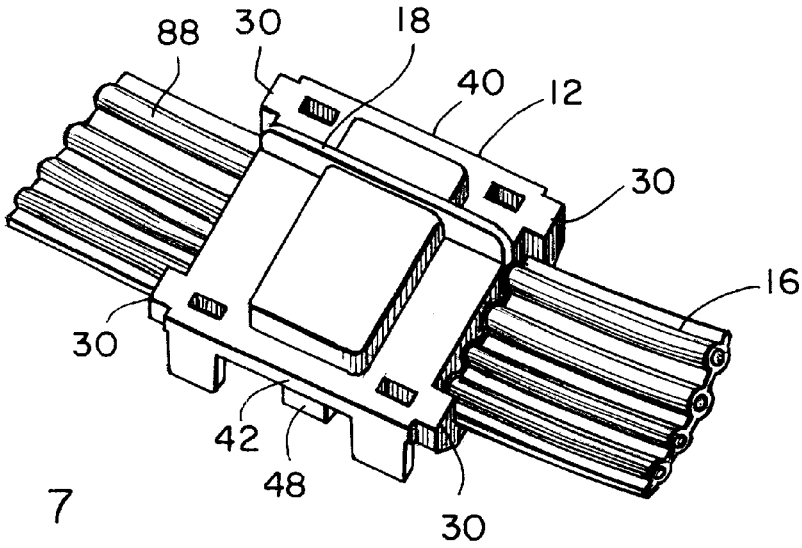
FIG. 7 is a drawing of the connector cap of FIG. 1 in line slideable relation with a ribbon bus.

Referring now to FIGS. 5 and 6, each base 14 preferably includes a first cap engagement area 60 and a second cap engagement area 62 where the first and second cap engagement areas 60, 62 are substantially identical. Each cap engagement area 60, 62 includes molded tracks 64 adapted to receive a bus connector 16 and are preferably overlain with a sealant 66 in a shape preformed to the bus 16 so as to seal around the bus connector 16 in a weatherproof manner. Each track 64 includes a contact 70 having one or more edges 72 adapted for engaging a particular electrical connecting line 80 in the bus connector 16, cutting through the insulating cover and making electrical connection between the contact and the actual electrical conductive line 80. In the preferred embodiment, the bus connector 16 includes four electrical connector lines 82, 84, 86 and 88 held in flat relationship by a plastic ribbon 90 to form a plastic ribbon cable 92.

Each cap engagement area 60, 62 includes a contact 94 adapted to engage the line 88, a contact 96 adapted to engage the line 86, a contact 98 adapted to engage the line 84, and a contact 100 adapted to engage the line 82. Within and insulated by the base 14 itself, the contact 100 of cap engagement area 60 is electrically connected to the contact 100 of cap engagement area 62. Similarly, contacts 98, 96 and 94 of cap engagement area 60 are respectively electrically connected within the base 14 to the contacts 98, 96 and 94 of the cap engagement area 62.

The cap engagement areas 60, 62 are located on a top side 110 of the base 14. The bottom side 112 of the base 14 includes apertures 114, 116, 118 and 120. The aperture 116 provides an electrical access point to an electrical connection 122 connecting the contacts 94. The aperture 114 provides access to an electrical connector 124 connecting the contacts 96. The aperture 120 provides access to an electrical connector 124 connecting the contacts 98, and the aperture 118 provides access to an electrical connector 128 providing access to the contacts 100. The apertures 114, 116 are generally associated with the cap engagement area 60, while the apertures 118, 120 are generally associated with the cap engagement area 62 so as to provide a maximum over surface distance between the lines 82, 84 and the lines 86, 88 and thereby minimize corrosion crossover. Each aperture 114, 116, 118 and 120 basically functions as an electrical test point 130 allowing the effectiveness of the bus connector 10 to be tested by testing and reading the electrical signals through the test points 30 of each line 82, 84, 86 and 88 of the bus 16 itself.

The base 14 includes cap alignment guides 140 aligned with the track 64 holding the contacts 94. Both a first side 142 and a second side 144 preferably include the guides 140.

The base 14 includes projections 150 for engaging mating indentations on bus connector caps 12. The base 14 also includes a receptacle 160 in each cap engagement area 60, 62 adapted to receive the projection 46. Similarly, the base 14 includes a second receptacle 162 adapted to receive the projection 48.

To assemble the bus connector 10, a bus connector cap 12 is aligned with and placed on a bus 16 such that the electrical lines 80 are in the tracks 20. In the preferred embodiment, the electrical lines 94, 96 are of a different gauge than the lines 98, 100 and there are two sizes of tracks 170, 172 to help ensure that the bus 16 and the bus connector cap 12 are aligned in a single alignment. Additionally, the guide 18 is aligned with the electrical line 88 thru the use of color coding the line 88 and the guide 18. The retainers 30 and the sealant 22 engage the flat ribbon cable 92 in an interfering manner so as to prevent the sliding of the bus connector cap 12 with relation to the cable 16 in a frictional manner.

Figure 8:
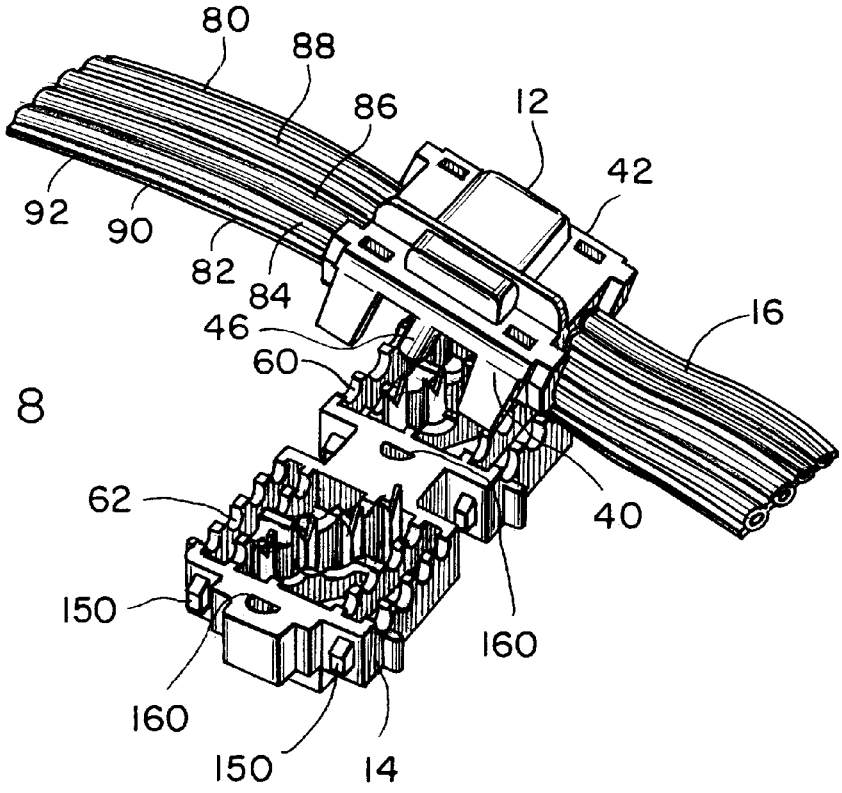
FIG. 8 shows the cap and bus of FIG. 7 in pre-assembly relation with the connector base.
Figure 9:
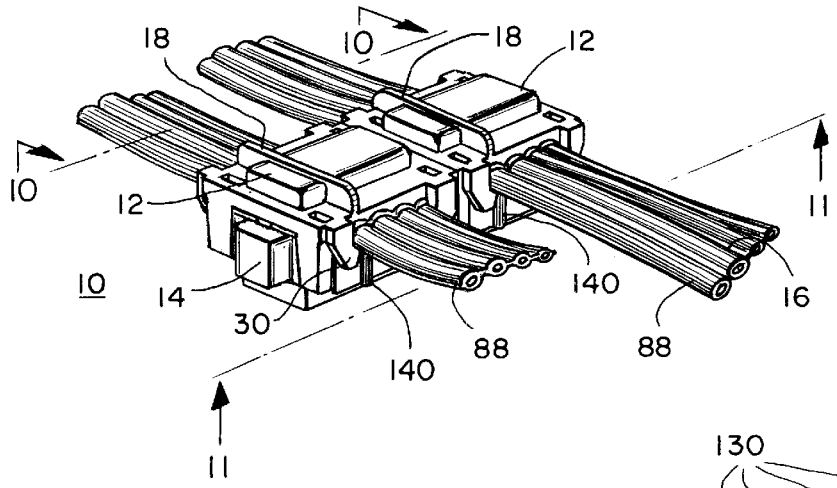
FIG. 9 is a drawing of the bus connector of the present invention in perspective with a pair of connector caps securing a pair of ribbon buses to a connector base.
Figure 10:
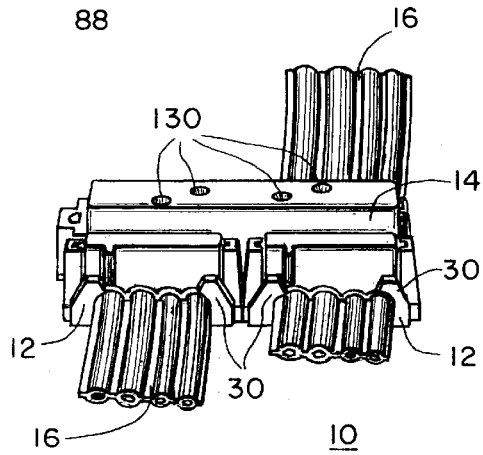
FIG. 10 shows the assembled connector of FIG. 9 along lines 10—10.
Figure 11:
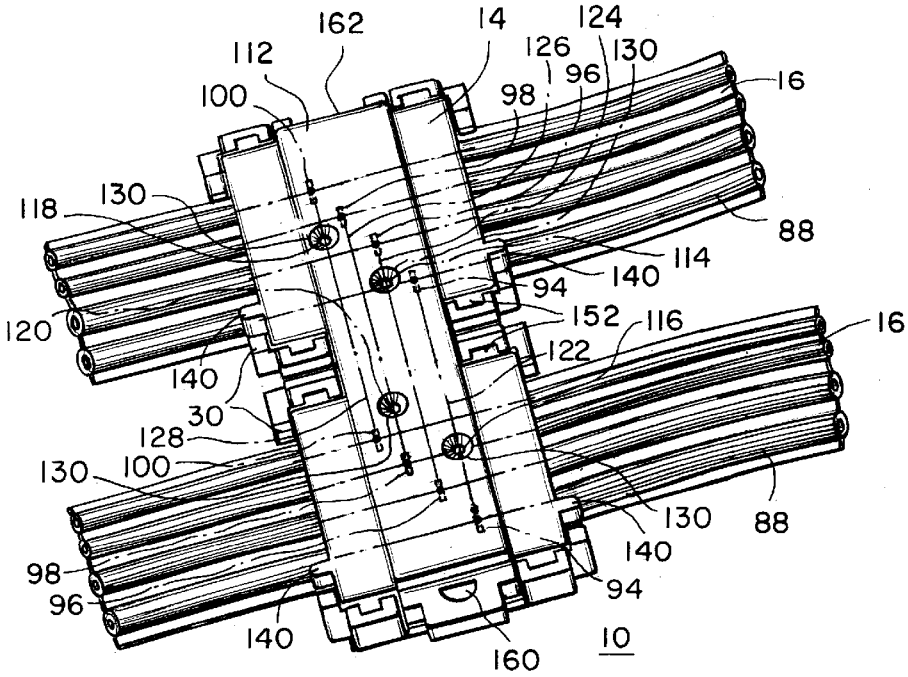
FIG. 11 shows the assembled connector of FIG. 9 along lines 11—11.

As is shown in FIG. 8, the bus 16 and the bus connector cap 12 are then moved over the desired cap engagement area 60, 62, the projection 46 is aligned with the retention area 160, the projection 48 is aligned with the rejection area 48, and the bus retainer cap 12 is pressed into engagement with a cap engagement area 62 such that the projections 150 retain and operably engage the receptacles 152. The same procedure is repeated with a second receptacle connector cap 12 and a second bus 16. This completed bus connector 10 is shown in FIGS. 9, 10 and 11. Correct assembly is assured by aligning the guides 18, the electrical lines 88 and the guides 140 of the respective bus connector cap 12, the bus 16, and the bus connector base 14.

In the preferred embodiment the electrical line 88 provides power, the line 86 is also part of the power circuit acting as a ground or common line, while the lines 84 and 82 provide a conventional two line RS-485 communications protocol.

What has been shown is a bus connector for connecting two ribbon cable buses operably and electrically using a pair of connector caps and a connector base. It will be apparent to a person of ordinary skill in the art that many changes and modifications could be made. The nature of the bus itself could be varied to a variety of conventional media including increasing or decreasing the number of electrical connecting lines in the ribbon bus, changing from a ribbon bus to other forms of electrical connecting buses or other conventional modifications. Additionally, the alignment and orienteering guides can be modified to other shapes and arrangements. Moreover, the electrical test points are shown in the preferred embodiment to include half of the test points relating to each connector cap. A person of ordinary skill in the art would recognize that all of the test points could be in direct relation to either cap or in various proportions thereto. All such modifications and alterations are contemplated to fall within the spirit and scope of the claimed invention.

What is desired to be secured for Letter Patent of the United States is set forth in the following claims.

What is claimed is:

1. A system for electrically connecting electrical components, the system comprising:

a first ribbon cable;

a connector cap including a track area adapted to operably engage the ribbon cable, a cap alignment guide, and a cap orientation guide; and a connector base having a first ribbon cable receptacle area adapted to electrically engage a first ribbon cable, a second receptacle area adapted to electrically engage a second ribbon cable, electrical interconnection means electrically interconnecting the first and second receptacles, first and second base alignment guides respectively positioned adjacent the first and second receptacle areas for alignment with the cap alignment guide, and a orientation receptacle operably positioned to receive the cap orientation guide.

2. The system of claim 1 wherein the base includes a first electrical test point in operable connection with the electrical connectors and having a first external access point.

3. The system of claim 2 wherein the orientation guide for the connector cap includes a projection having a first shape and wherein the connector base orientation receptacle is of a corresponding shape and position to receive the orientation guide.

4. The system of claim 3 wherein the orientation guide includes a second projection having a second shape and the orientation receptacle includes a second aperture of a similar shape as the second projection and adapted to receive same, and wherein the orientation guide and the orientation receptacle are positioned such that a connector cap can only be assembled to a connector base in one orientation.

5. The system of claim 4 further including a second ribbon cable wherein the first and second flat ribbon cables include electrical connecting wires of different gauges and wherein the connector base and the connector cap respectively include cap and base tracks having varying size portions operatively adapted to receive the varying gauge electrical lines of the first and second ribbon cables.

6. The system of claim 5 further including a second, a third and a fourth electrical test point in operable connection with the electrical connectors and having second, third and fourth external access ports respectively.

7. The system of claim 5 wherein the electrical test points are in two groupings: a first grouping physically associated with the first receptacle area and a second grouping physically associated with the second receptacle area.

8. The system of claim 7 wherein the first group is spaced in distance from the second grouping.

9. The system of claim 5 wherein the connector cap includes retainer arms adapted to frictionally engage the web.

10. The system of claim 3 wherein the cap alignment guide, and the first and second base alignment guides are color coded to match a color of a particular conductor in the flat ribbon cable.

11. The system of claim 2 wherein the first ribbon cable includes first sized conductor, a second sized conductor, and a web around the first and second conductors.

12. A connector for operably connecting a first and a second communications bus, the connector comprising:

a connector base including first and second substantially identical cap engagement areas, each cap engagement area including tracks adapted to receive the first or second communications bus and contacts for each track adapted to electrically engage a portion of said communications bus, each contact in a cap engagement area being in electrical connection with a corresponding contact in the other cap engagement area to form electrically connected pairs of contact;

a first bus connector cap including tracks sized to receive and retain the first or second communications bus;

wherein the base includes an external aperture in association with each pair of electrically connected contacts providing an external electrical access point thereto.

13. The connector of claim 12 wherein the first and second communications bus are flat ribbon cables.

14. The connector of claim 13 wherein the bus connector cap includes an outer surface having an alignment guide and wherein the connector base includes first and second base alignment guides on an external surface of the base respectively associated with the first and second cap engagement areas.

15. The connector of claim 14 wherein the flat ribbon cable, the cap alignment guide and the first and second base alignment guides include a visual indicia to aide in assembly and aligning a portion of the flat ribbon cable, a cap alignment guide, and either a first or second base alignment guide.

16. The connector of claim 15 the connector cap further including retaining arms adapted to engage and retain said communication bus.

17. The connector of claim 16 including a second bus connector cap substantially identical to the first bus connector cap wherein the first connector cap operatively engages the first cap engagement area and the second connector cap operatively engages the second cap engagement area.

18. The connector of claim 17 wherein the connector cap tracks and the connector base tracks include portions of two different sizes, and wherein the flat ribbon cable includes electrical connecting lines of different gauges such that the different portions of the tracks are sized to receive the different gauges of the electrical lines.

19. The connector of claim 18 wherein the connector base and the first and second connector caps are formed of a non-conductive material.

20. The connector of claim 19 wherein when the connector caps and the connector bases each include means for assembling a cap to a connector base in a single orientation.

21. The connector of claim 12 wherein when the connector caps and the connector bases each include means for assembling a cap to a connector base in a single orientation.

22. An electrical connector for connecting first and second communications buses, each bus including at least first and second conduits, comprising:

a non-conductive housing including a first receptacle portion and first contacts for receiving a first bus and a second receptacle portion and second contacts for receiving a second bus, the housing further including electrical connections operably and electrically interconnecting the first contacts with the second contacts;

first cover portion adapted for and operably engaging the first receptacle portion to form a first electrical connection between the first contacts and the first bus such that the first electrical connection is insulated from external electrical contacts;

second cover portion adapted for and operably engaging second receptacle portion to form a second electrical connection between the second contacts and the second bus such that the second electrical connection is insulated from external electrical contacts;

the housing further including at least one electrical test point in operable connection with the first electrical connection wherein the electrical test point has an external contact surface allowing an external device to monitor at least one electrical condition of the respective connection.

23. The electrical connector of claim 22 including an alignment guide on the first cover portion and corresponding alignment guides adjacent to the first and second electrical connection areas.

24. The electrical connector of claim 23 wherein the cover portion includes an anti-slide feature.

25. The electrical connector of claim 23 wherein the cover portion includes means for assembling the cover portion to the housing in a single orientation.

26. The electrical connector of claim 22 wherein the at least one electrical test point comprises first, second, third and fourth electrical test points each having a respective electrical contact surface with respective first, second, third and fourth electrical lines in the first and second buses.

* * * * *

UNITED STATES PATENT AND TRADEMARK OFFICE

CERTIFICATE OF CORRECTION

PATENT NO. : 6,398,581 B1 
DATED : June 4, 2002
INVENTOR(S) : Terence D. Baier and Paul C. Rentmeester It is certified that error appears in the above-identified patent and that said Letters Patent is hereby corrected as shown below:

Column 5,
Lines 13 and 14, delete “electrically”.
Line 15, after the word “electrical” insert -- electrically engaging the first and second ribbon cables and electrically --.
Line 17, delete “receptacles” and insert -- ribbon cables --.

Signed and Sealed this

Twenty-fifth Day of March, 2003

JAMES E. ROGAN
*Director of the United States Patent and Trademark Office*